US007086566B2

(12) United States Patent
Goepfert

(10) Patent No.: US 7,086,566 B2
(45) Date of Patent: Aug. 8, 2006

(54) UNDER COUNTER DISPENSER

(75) Inventor: Gerard F. Goepfert, Scottsdale, AZ (US)

(73) Assignee: CreaMiser Products Corporation, Scottsdale, AZ (US)

( * ) Notice: Subject to any disclaimer, the term of this patent is extended or adjusted under 35 U.S.C. 154(b) by 0 days.

(21) Appl. No.: 10/613,973

(22) Filed: Jul. 3, 2003

(65) Prior Publication Data

US 2005/0000980 A1 Jan. 6, 2005

(51) Int. Cl.
*B65D 35/28* (2006.01)

(52) U.S. Cl. ..... 222/64; 222/95; 222/135; 222/146.6; 222/608; 222/386.5

(58) Field of Classification Search ..... 222/1, 222/64, 95, 105, 135, 146.6, 608, 386.5
See application file for complete search history.

(56) References Cited

U.S. PATENT DOCUMENTS

| | | | | |
|---|---|---|---|---|
| 2,895,653 | A | | 7/1959 | Giepen |
| 3,035,737 | A | | 5/1962 | Speas |
| 3,445,039 | A | | 5/1969 | Brodsky et al. |
| 3,677,443 | A | | 7/1972 | Smadar et al. |
| 4,204,613 | A | | 5/1980 | Terzian et al. |
| 4,308,975 | A | | 1/1982 | Bowen |
| 4,335,836 | A | | 6/1982 | Harvill |
| 4,337,769 | A | * | 7/1982 | Olson ..... 604/251 |
| 4,634,092 | A | | 1/1987 | Daniell et al. |
| 4,687,120 | A | | 8/1987 | McMillin |
| 4,723,688 | A | | 2/1988 | Munoz |
| 4,757,920 | A | | 7/1988 | Harootian, Jr. et al. |
| 4,796,788 | A | * | 1/1989 | Bond ..... 222/94 |
| 4,907,723 | A | | 3/1990 | Katz |
| 4,921,135 | A | | 5/1990 | Pleet |
| 4,979,647 | A | | 12/1990 | Hassell |

(Continued)

FOREIGN PATENT DOCUMENTS

| | | |
|---|---|---|
| WO | 99/00320 | 7/1999 |

(Continued)

*Primary Examiner*—Joseph A Kaufman
(74) *Attorney, Agent, or Firm*—Gallagher & Kennedy, P.A.; Thomas D. MacBlain

(57) ABSTRACT

A dispenser for liquid consumables locates a store of the particular liquid at a location remote from the dispensing location. The dispensing location is typically located above a counter and may include a relatively narrow stem that brings a flexible liquid delivery tube up to a valve. Valuable counter space is conserved. One or more disposable, flexible and collapsible bags contain the store of liquid and communicates with the dispensing location via the liquid delivery tube. Confined in contact with each flexible bag is an inflatable bladder to which compressed air is routed. Liquid is dispensed each time the valve opens. When exhausted the flexible bag is replaced. Safety interlock switches vent the inflatable bladder to prevent its expanding explosively upon opening of the location where the liquid containing bag will replace the empty. Where the liquid needs temperature control, temperature control means are provided where the liquid is stored. Air movement from that location into the stem to a dispensing fountainhead controls the temperature of the liquid in the delivery tube. In the dispensing of dairy product, as in cream for coffee, temperature control is refrigeration. The dairy product is cooled over its entire route from the flexible bag to the fountainhead. The location of the collapsible, flexible bag and expansible bladder may be directly below the stem and fountainhead in a cabinet, and the entire unit may be movable from one location to another. When consistency of liquid amount dispensed is needed, a dosing valve meters out a measured amount.

11 Claims, 16 Drawing Sheets

U.S. PATENT DOCUMENTS 5,096,092 A * 3/1992 Devine ..... 222/95
5,188,334 A 2/1993 Yoshii et al.
5,190,188 A 3/1993 Credle, Jr.
5,251,790 A 10/1993 Cohn et al.
5,339,986 A 8/1994 Mihalich
5,439,145 A 8/1995 Salkeld et al.
5,492,250 A 2/1996 Sardynski
5,553,749 A * 9/1996 Oyler et al. ..... 222/129.1
5,855,298 A 1/1999 Teetsell, III et al.
5,915,602 A * 6/1999 Nelson ..... 222/608
5,938,078 A 8/1999 Dorsey et al.
5,996,842 A * 12/1999 Riley et al. ..... 222/1
6,026,988 A 2/2000 Teetsell, III et al.
6,082,590 A 7/2000 Dorsey et al.
6,095,372 A 8/2000 Dorsey et al.
6,102,251 A * 8/2000 Strother ..... 222/1
6,168,048 B1 * 1/2001 Xu et al. ..... 222/1
6,497,343 B1 12/2002 Teetsell, III

FOREIGN PATENT DOCUMENTS

WO 02/28763 11/2002

* cited by examiner

UNDER COUNTER DISPENSER

FIELD OF THE INVENTION

This invention relates to dispensers for consumable liquids, and more particularly to a dispenser that delivers consumable liquid from a container at one location, through a flow path to a dispensing location.

BACKGROUND OF THE INVENTION

Often, in the past, consumable liquid dispensers for delivering, for example, cream or milk to a consumer's coffee or tea has relied on gravity flow downward from a container to a dispensing location. This has meant that such dispensers were typically located entirely above a counter. These dispensers use valuable above-counter space that could be put to better use. The dispensing unit has to be large enough to house one or more containers of significant size. In addition refrigeration of the above-counter container or containers (essential for dairy products) further adds to the size of the above-counter unit.

Liquid consumables that are delivered under pressure such as beer or carbonated water can be remotely housed and delivered to a tap or dispenser at a bar or counter where drinks are prepared. Non-carbonated drinks like cream, milk and fruit juice have ordinarily not been delivered to a dispensing station in this manner. Beer is delivered to a remote tap by compressed air forced into direct contact with the beer in a keg. Where spoilage is a concern one would ordinarily like to avoid air contact with the liquid.

Non-carbonated liquid can be moved from one place to another by a pump. However, where the liquid is consumable (i.e. a food product), that raises concerns for sanitation. Pump parts that contact liquid require constant, repeated cleaning to maintain proper sanitary conditions.

There is a need, therefore, for a consumable liquid delivery system that does not require extensive counter space, that works to deliver non-carbonated liquids from a remote location, that does not contact the liquid with any movable part as would a pump and that moves the liquid other than by gravity.

Where, as in the case of dairy products, temperature of the consumable liquid is an important consideration, a further problem must be addressed. That problem is maintaining temperature of the liquid product in the path from its container or "store" to its dispensing location. For dairy products close temperature control at all points along the delivery system is a government requirement. In the U.S. dairy product must be maintained at a temperature above 32° and below 41° Fahrenheit within its container and along the length of the delivery tube.

A shortcoming of known dispensers of consumable liquids such as cream is lack of a consistent dose from one dispenser use to the next. In certain environments this is undesirable. Proprietors of many convenience stores and fast food restaurants where consumers operate the cream dispensers would prefer to know that each activation of the dispenser will provide the same dose. This is also true where an employee provides a beverage at a drive-through window. It is preferable for coffee with cream, for example, to be consistent from one restaurant to the next. Travelers that patronize chain restaurants often do so in the expectation that products they purchase will be virtually identical at each restaurant. So a consistent dose of cream, half and half or milk with every cup of coffee or tea is desirable.

SUMMARY

In accordance with this invention, a dispenser for consumable liquids delivers the liquid to a dispensing location from a remote store or container without reliance on gravity flow, without introducing air or other gas under pressure into contact with the liquid and without contacting the liquid with any moving part of a pump or the like. The mechanism for delivery of the liquid is gas pressure activated. In the preferred embodiment it is an inflatable bladder or air bag that engages a collapsible container such as a compressible bag containing the liquid. Compressed air is fed to the inflatable bladder, which is confined in its position in force exerting contact with the flexible, liquid-containing bag. The compressible bag opens to a liquid delivery path leading to the dispensing location. Preferably the path contains a flexible tube through which the liquid flows. In a preferred embodiment, flow is controlled by a pinch valve normally pinching the tube closed. Preferably both the flexible bag and the flexible liquid delivery tube are relatively inexpensive and can be discarded after the bag is exhausted of liquid. In a preferred embodiment no part of the mechanism for forcing the liquid out of the bag to the dispensing location ever touches the liquid. Maintaining sanitary conditions is made very easy. In this regard, distinction between the disposable, liquid-contacting parts (bag and tube) and reusable parts is made. The expression "permanent parts of the dispenser" is used. By "permanent part of the dispenser" is meant a non-disposable part of the apparatus that, unlike the collapsible liquid bag and the liquid delivery tube, is ordinarily reused from one refilling of the dispenser to the next.

Delivery of liquid to a dispensing location in the manner of this invention as described above permits even non-carbonated or "still" consumable liquids to be pumped from a remote location to a dispensing location. In one exemplary and preferred embodiment the remote location of the compressible, flexible liquid container is a below-counter location while the dispensing location is an above-counter location. A relatively narrow stem projecting upward from the counter leads one or more of the flexible liquid delivery tubes to the dispensing location. Little counter space is used for dispensing the liquid. The under-counter location containing the flexible liquid filled bag and the inflatable bladder can be refrigerated. Also a compressor or air pump for supplying compressed air to the bladder can be housed below the counter. The under-counter location can be in a cabinet directly under the dispensing location.

In the exemplary embodiment, the under-counter cabinet contains one or more enclosures or compartments. Each enclosure or compartment contains one or more of the flexible liquid filled bags and one or more bladders in contact with the bag or bags. Each enclosure that is equipped with one or more of the inflatable bladders has a structure that confines the bladder in contact with the flexible bag so that pressure from the bladder is exerted against the flexible liquid-containing bag. In an exemplary preferred embodiment described below the enclosure is a slidable drawer and the structure confining the bladder in contact with the bag is a stationary lid supporting the drawer for sliding movement. Preferably, as a safety feature, one or more safety shut off switches serve to relieve the pressure in the bladder or bladders in an enclosure when the enclosure is opened. The switch or switches serve as safety interlock devices, preventing pressure in the inflatable bladder or bladders expanding the bladder explosively when the drawer is slid out from under its lid, possibly injuring an attendant.

In an embodiment where a variety of products are dispensed, the enclosures and the liquid containers that they accommodate can be of various sizes so as to take into account varying demand for the products. The enclosure can be modular, entirely removable and replaceable so as to permit a dispenser to be modified and tailored to the needs of a particular installation. In the case of the drawer and stationary lid, both drawer and lid can be attached and detached as a single module facilitating removal and replacement of one size enclosure with another.

In one embodiment of the invention, the liquid delivery system delivers one or more of cream, non-dairy creamer, milk, half and half and/or other coffee and tea additives such as flavorings from the flexible bags at the below-counter location to the above-counter dispensing location. In a fast food restaurant, convenience store or elsewhere, valuable counter top space is conserved.

In one particular embodiment, a below-counter cabinet containing the consumable liquid store is on wheels, casters or sliders or other means facilitating the movement of the cabinet, making the cabinet, its counter and the liquid dispenser easily moved from one location to another. This is an embodiment useful for hotels and resorts that set up refreshments at various locations in connection with conferences, meetings, parties, etc. held in various conference rooms.

In any of the above embodiments of the invention, where refrigeration of the liquid to be dispensed is important, cooling by the refrigeration unit can extend upward from an under-counter location to a location at or very near the dispensing location. This is important in dispensing dairy product such as cream, milk or half and half for coffee or tea. Where, as described above, a stem containing a liquid delivery tube extends upward from a counter-top, that stem's interior can be in communication with the refrigerated location of the liquid bag or bags below the counter in accordance with one aspect of this invention. Cooling of the stem interior by convection can be assisted by a fan moving refrigerated air into the liquid delivery, path. Additionally for good conduction of heat away from the liquid dispensing location and away from the flexible tube or tubes leading the liquid to the dispensing location, a return air flow channel may extend into and along the inside of the stem.

Preferably, too, in some embodiments, the pinch valve or valves that normally pinch the one or more flexible tubes closed are electrically operated from a manually activated switch or switches at the dispensing locations. Electrical solenoid-operated pinch valves suitable for use in this invention are commercially available items. Although, without departing from the invention, manually operated pinch valves can be used. These may be of the kind described in U.S. Pat. No. 6,186,361, incorporated herein by reference. In either case the valves, their manual actuators and the stem that communicates with the under counter refrigeration unit can be part of a dispensing head supported on the stem.

An aspect of this inventive liquid dispenser addresses the problem of consistency in doses of coffee or tea additives. This is a dosing valve that meters out a consistent dose of the additive each and every time the dispenser is operated. The valve is a slide valve that, when the slide is spring biased to its "home" position defines a chamber in a close fitting housing in which the slide moves. The chamber, so-defined, is in communication with the tube supplying the additive from the collapsible bag that is the additive store. Movement of the slide to the dispensing position moves a liquid path formed in the slide between the chamber and a liquid emission opening through a wall of the housing. At the same time the slide closes the communication path between the chamber and the tube. An air passage between the outer surface of the slide and its housing allows the slide to return towards its home position under the influence of the biasing spring until the communication is again established between the chamber and the additive supply tube. As the additive again fills the chamber, air is displaced and escapes along the air passage.

The above and further objects and advantages of the invention will be better understood in connection with the following detailed description of the invention taken in consideration with the accompanying drawings.

DETAILED DESCRIPTION

Figure 1:
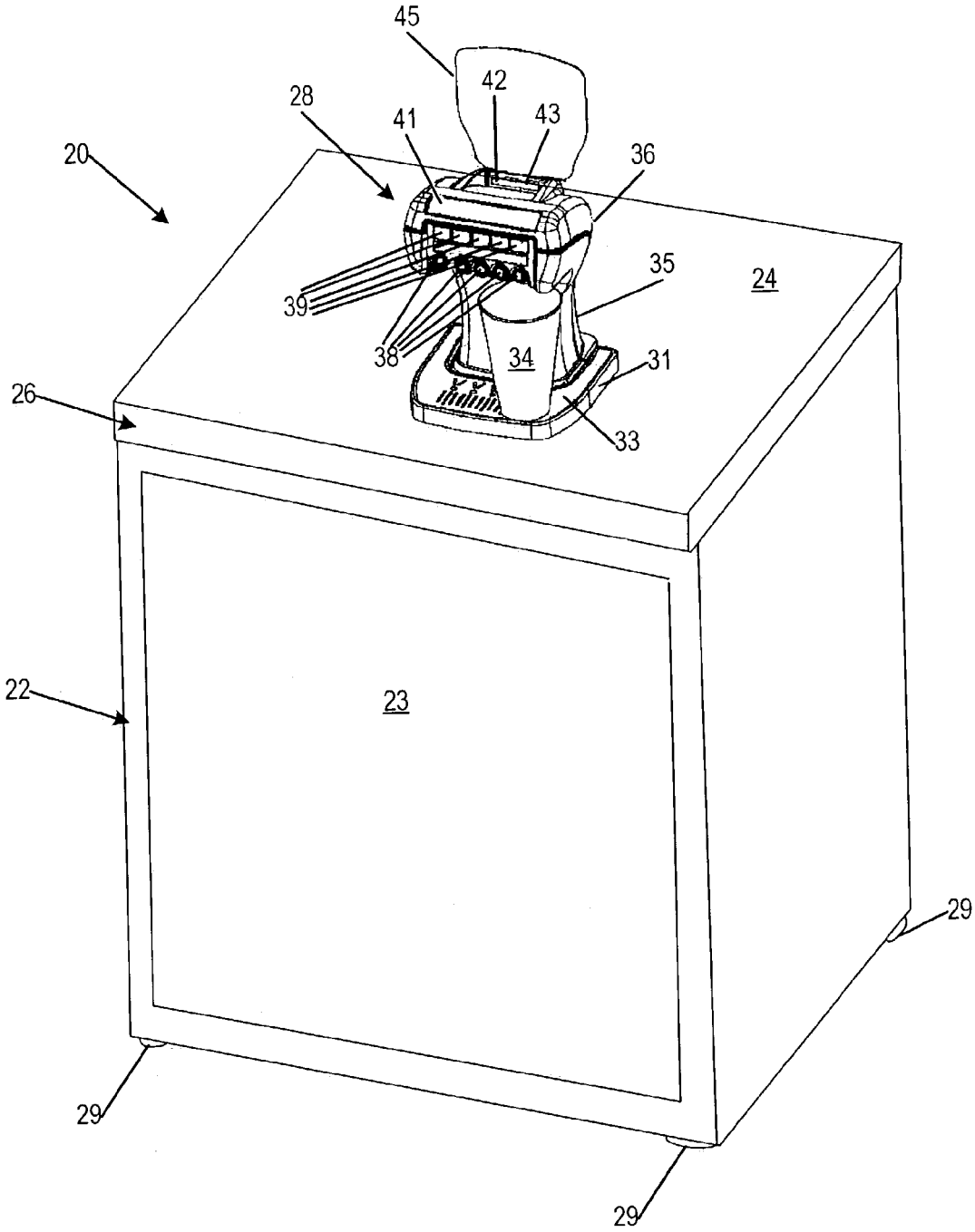
FIG. 1 is a perspective view of an installed consumable liquid dispensing station according to this invention and shows a fountainhead installed on a countertop above a cabinet housing a store of consumable liquids.

Turning now to FIG. 1 there is shown a consumable liquid dispensing station 20 in accordance with the invention. The station 20 includes a cabinet 22 having a door 23 and an upper surface 24 formed by a counter 26. A fountainhead 28 is secured to the upper surface 24. Wheels, casters or sliders 29 at the bottom of the cabinet 22 afford easy movement of the station 20.

The fountainhead 28 has a base 31 resting on the counter surface 24. A drip tray 33 is shown supporting a cup 34. A hollow stem 35 extends upwardly from the base 31 supporting a dispensing head 36. A series of five manually activated push buttons 38 are the activators of manually operable pinch valves that normally pinch closed five flexible consumable liquid supply tubes as described in greater detail below. A user pushes one or more of the push buttons 38 to choose the consumable liquid of choice. The available products are identified at the five displays 39 aligned with the push buttons 38. Additional information can be displayed at a display area 41. This can be a passive or active electronic display. At 42 can be found a temperature readout of temperature in the fountainhead as determined by a suitably chosen, commercially available temperature sensor located there. At 43 low product and out of product indications are provided by LEDs. Supported on the fountainhead 28 in a fashion described in greater detail below is a placard 45 that may contain advertising or additional product information. The fountainhead 28 is particularly well suited for supplying coffee or tea additives such as cream, half and half, non-dairy creamer, flavorings, etc., but can be as well, a dispenser of fruit juices, water or other beverages. In the embodiment of FIG. 1 the station 20 is readily moved to a location such as a hotel or resort conference room to serve at conference breaks, for example. Unlike prior dairy and non-dairy coffee additive dispensers, the fountainhead 28 leaves open a substantial amount of countertop that can be put to further good use. In the conference setting, this may support the familiar carafes of coffee and tea.

Figure 2:
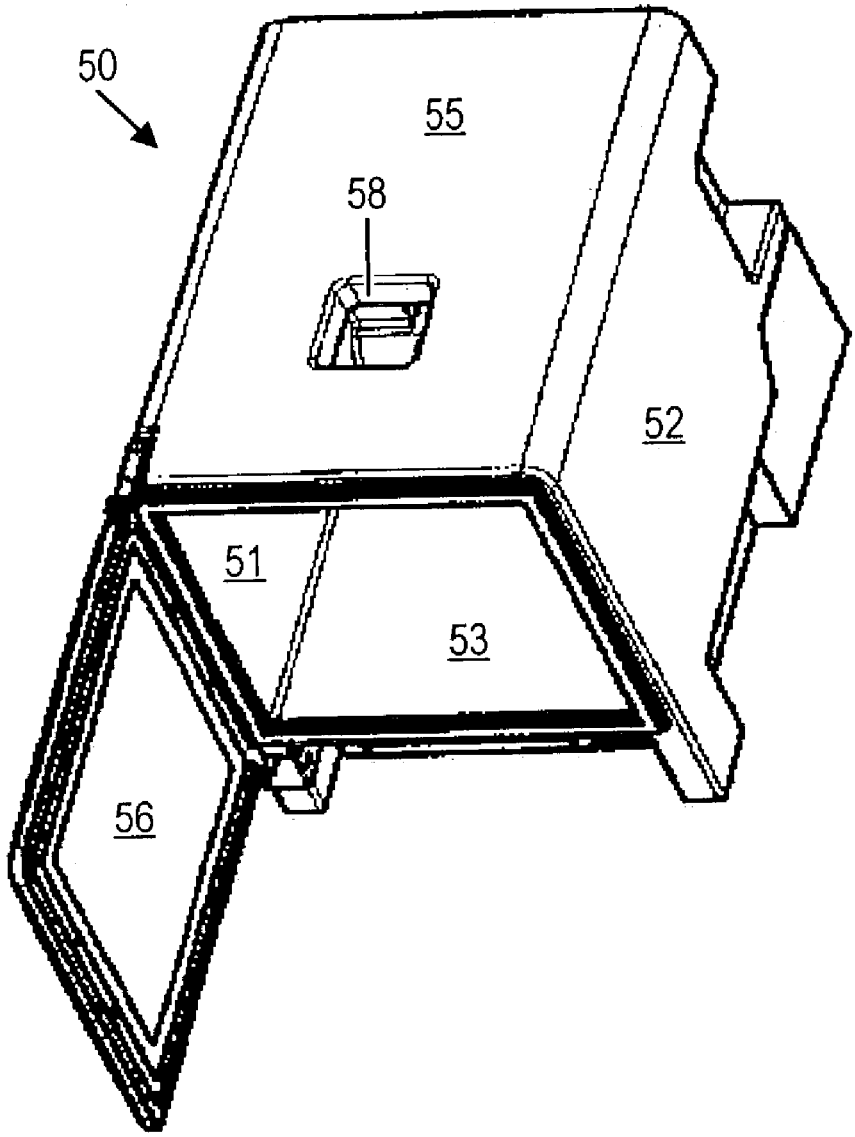
FIG. 2 is a further perspective view of a refrigeration unit outer shell for installation in a cabinet like that of FIG. 1.
Figure 9:
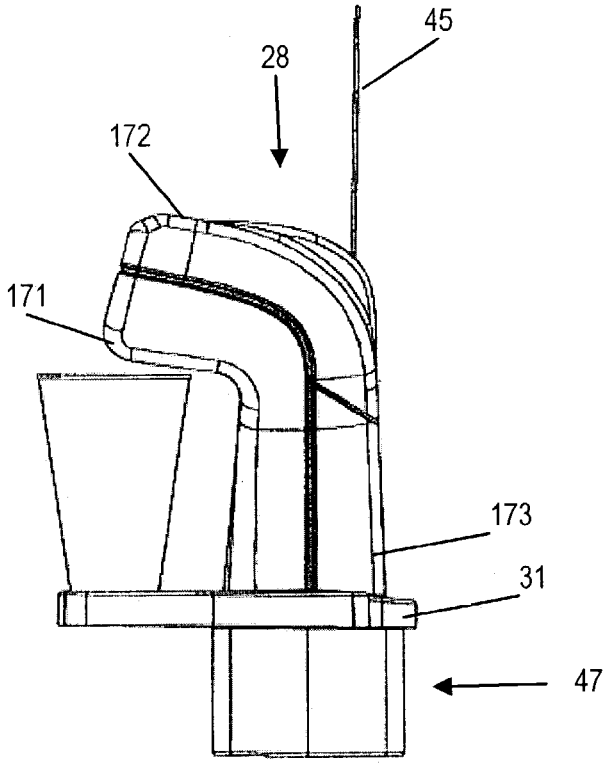
FIG. 9 is a right side elevation view of the fountain head of FIG. 1.
Figure 10:
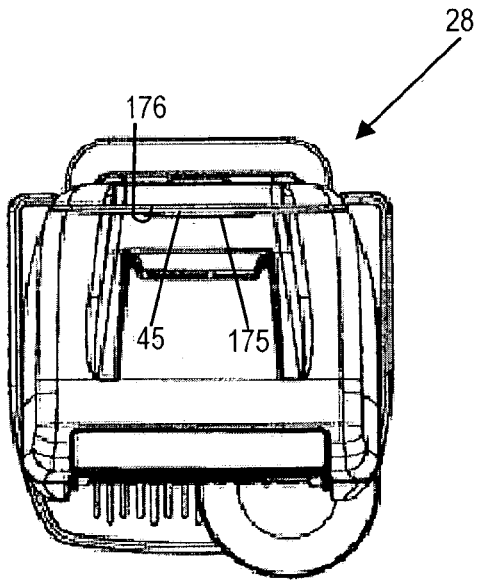
FIG. 10 is a top plan view of the fountainhead of FIG. 9.

The cabinet 22 of FIG. 1 houses a refrigeration unit 50. That unit's shell appears in FIG. 2. The shell is an insulated box-like structure with insulated walls 51 and 52, an insulated floor 53 and an insulated top wall 55. It is sized to fit closely within the cabinet 22 of FIG. 1. An insulated door 56 swings open as shown in FIG. 2 to allow access to the interior of the refrigeration unit. A magnetic latch (not shown) like that used on home refrigerators ordinarily holds the door 56 closed. At 58 a generally square opening through the top 55 of the shell communicates between the interior and exterior of the unit. Into this opening a lower stem of the fountainhead 28 will extend. Such a stem 47 can be seen in FIGS. 9 and 14, for example. To accommodate the stem an opening similar in size to the opening 58 is formed in the counter 26 of FIG. 1 in alignment with the opening 58.

Figure 3:
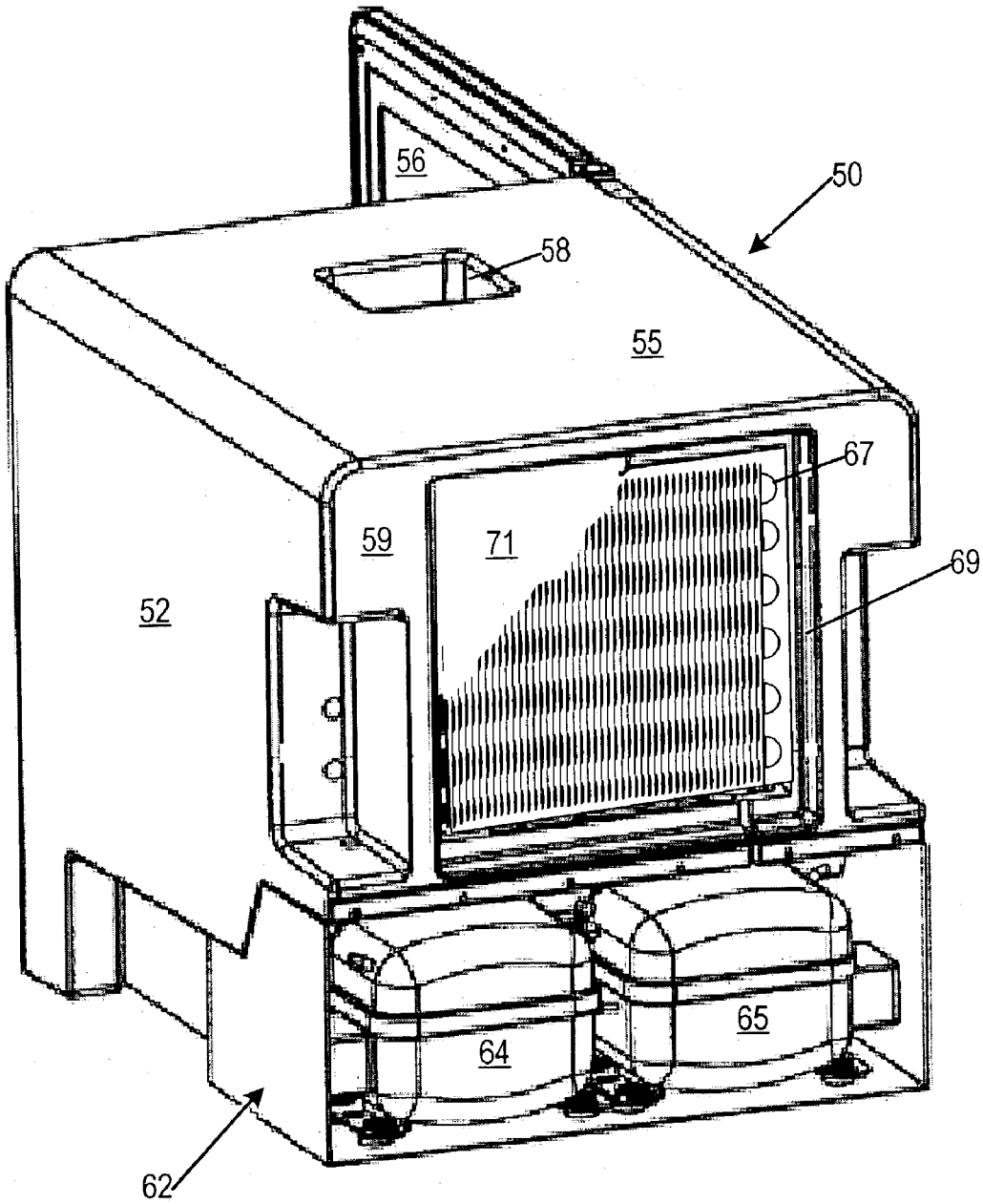
FIG. 3 is a further perspective view of the refrigeration unit and shows a pair of pumps and an evaporator installed in place in the back of the refrigeration unit.

Turning to FIG. 3 the refrigeration unit 50 is again seen, but in perspective view from the rear 59 and side 52 of the unit. In a subassembly 62 a pair of pumps 64 and 65 are housed. One of these pumps, 64, supplies compressed air and the other, 65, pumps refrigerant. The refrigeration unit's evaporator 57 is located in a recess 69 in the back 59 of the unit 50. The recess 69 ultimately is closed by a panel 71, a fragment of which is shown in FIG. 3. Because the opening 58 in the top of the refrigeration unit 50 is generally square in cross section, as is the stem 47 that extends into it, the fountainhead 28 can face in any of four directions, as the particular installation site may dictate.

Figure 4:
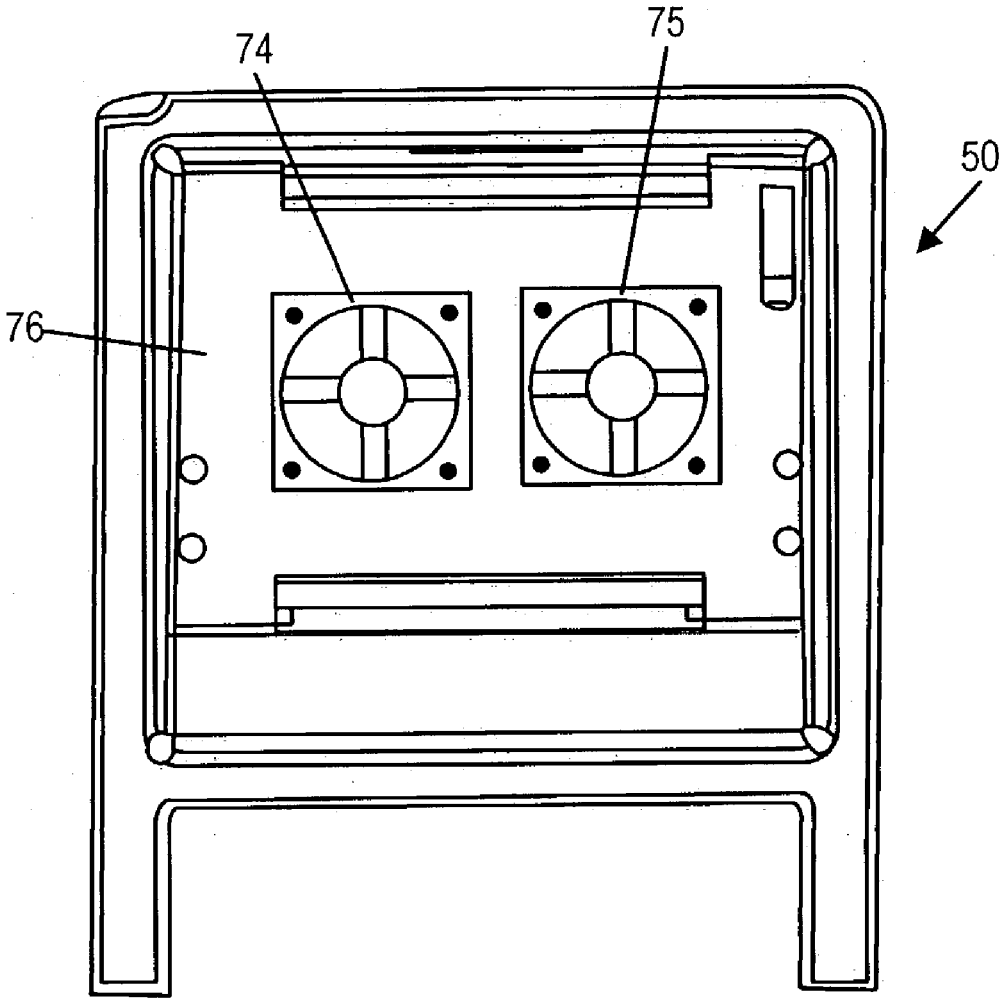
FIG. 4 is a front elevation view of the refrigeration unit shell with door removed and shows a pair of fans located to move air over the evaporator of FIG. 3.

In FIG. 4 the refrigeration unit 50 is shown with its door removed. Looking into the interior, one sees a pair of fans 74 and 75. These draw air over the evaporator 67. They are installed inward of the evaporator in a partition 76.

Figure 5:
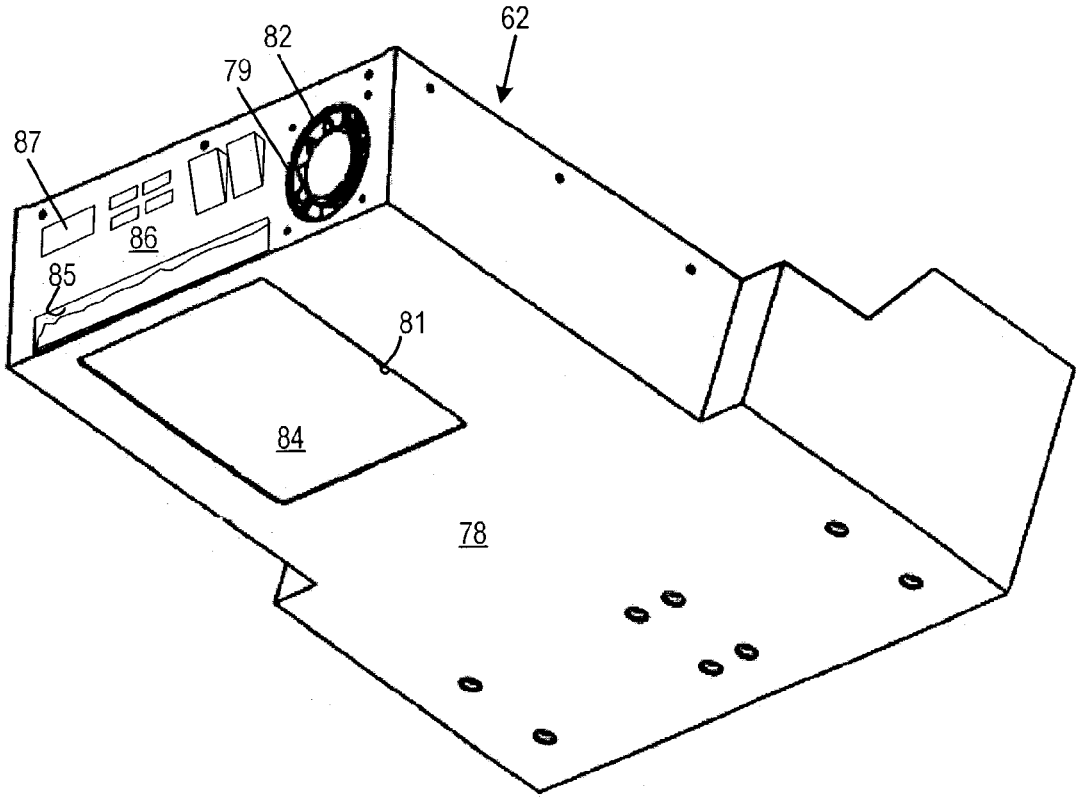
FIG. 5 is a perspective view upward from the front and bottom of a refrigerator subassembly housing the condenser of the refrigeration unit and shows a fan for moving air through an opening and over a condenser.

In FIG. 5 the subassembly 62 appears in perspective looking up from its bottom 78. A fan 79 draws air into the subassembly housing through an opening 81 in the bottom 78 and expels that air at the opening 82 where the fan 79 is secured. A filter 84 is inserted through an opening 85 in the front face 86 of the subassembly 62 to filter air introduced into the subassembly and prevent dust build-up on a condenser, 88 in FIG. 7, that is housed in the subassembly 62. Also in FIG. 7, on top of the condenser 88, where evaporation is aided by greater warmth, a catch basin 89 receives condensation via a tube 90 from a drip tray 83 below the evaporator 67. A further temperature display 87 is on the face of the subassembly 62. Controls for the refrigeration unit 50 may be located on the face of the subassembly 62. The temperature is that within the refrigeration until 50 as measured as known in the art by a suitably chosen commercially available temperature sensor.

Figure 6:
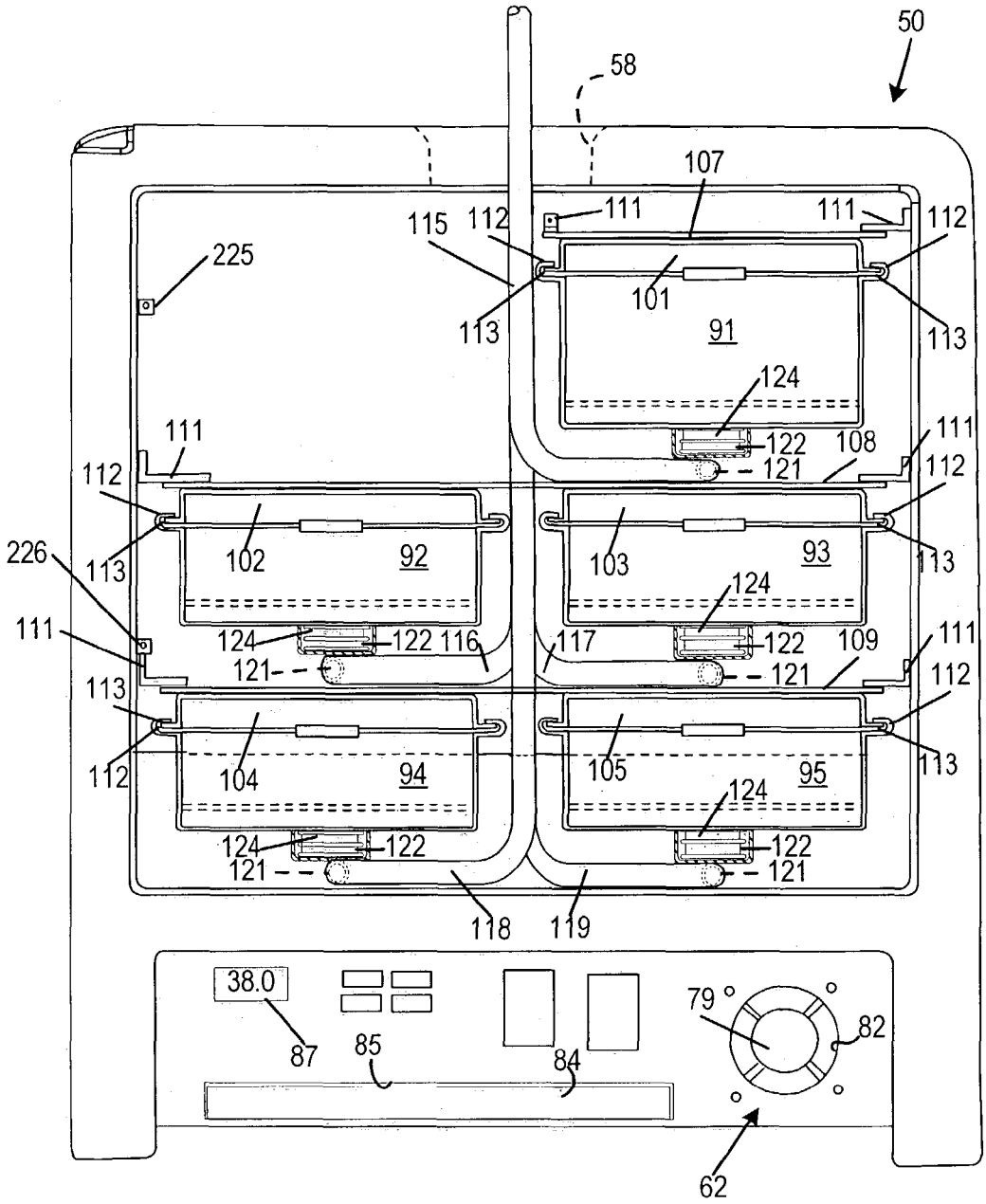
FIG. 6 is a front elevation unit of the refrigeration unit with door removed and showing a number of consumable liquid storage drawers housed in the refrigeration unit.

In FIG. 6 the interior of the refrigeration unit 50 is illustrated with five drawers 91–95 in place. Each drawer is equipped with a lid 101–105. Each lid is affixed to the underside of a shelf 107, 108 or 109. Brackets 111 or other supporting means secure the shelves in place. Each drawer 91–95 has a pair of U-shaped channels 112 formed along the sides thereon. Each lid 101–105 has a pair of laterally outwardly projecting flanges 113 received in each of the channels 112 and supporting the associated drawer. Thus supported, the drawers 91–95 are able to slide forward toward the open front of the refrigeration unit 50.

As is evident in FIG. 6, the drawer 91 is larger than the remaining drawers 92–95. This drawer 91, then, is used to contain a larger collapsible bag and to supply the product most often chosen by users of the dispenser 20. Of course, other configurations with varying drawer sizes and fewer or more drawers for the dispensing of fewer or more products may be readily accomplished.

Figure 6A:
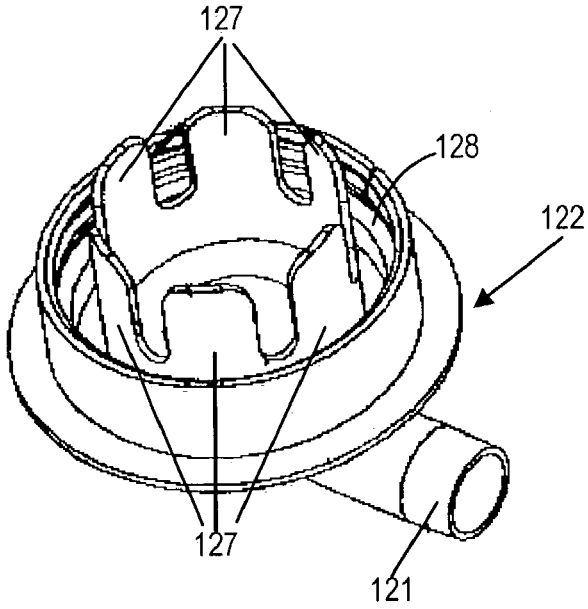
FIG. 6A is a perspective view of a fitment that forms an outlet of a flexible bag of the consumable liquid.
Figure 6B:
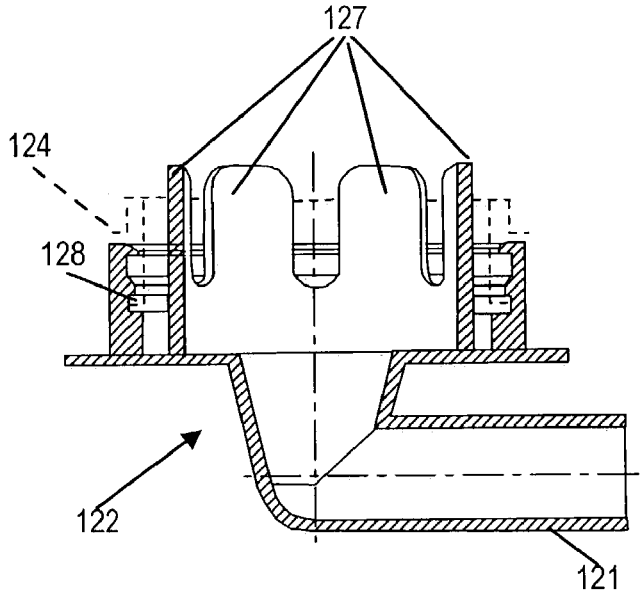
FIG. 6B is a cross-sectional view of the fitment of FIG. 6*a;*

Five flexible liquid supply tubes 115–119 extend from the drawers 91–95 upward to the fountainhead through the opening 58. At their lower ends, the tubes 115–119 connect with hollow outlet connections 121 of a series of fitments 122. These fitments 122, better seen in FIGS. 6A and 6B, fit onto five outlet connections 124, each secured to a consumable liquid supply bag 125 (FIG. 7A) in each of the drawers 91–95. As shown in FIGS. 6A and 6B, each fitment 122 has a series of spaced prongs 127. The connection 124, which opens into each interior consumable liquid bag extends downward and into the interior 128 of the fitment 122 as indicated in dashed lines in FIG. 6B. The two pieces snap securely together. The fitment defines the liquid flow path from the interior of the collapsible container that is the bag 125 to the attached liquid supply tube.

Figure 7:
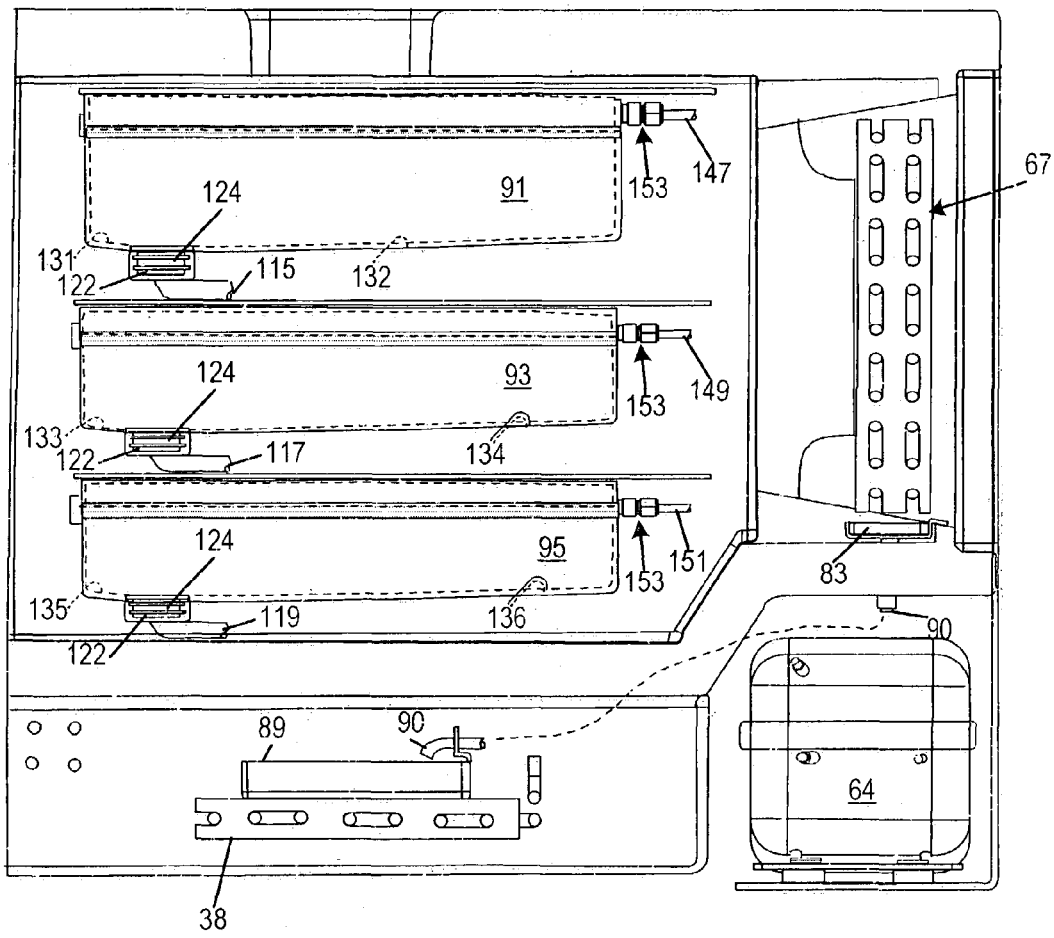
FIG. 7 is a cross-sectional view of the refrigeration unit and drawers of FIG. 6 along with the evaporator and condenser.
Figure 7A:
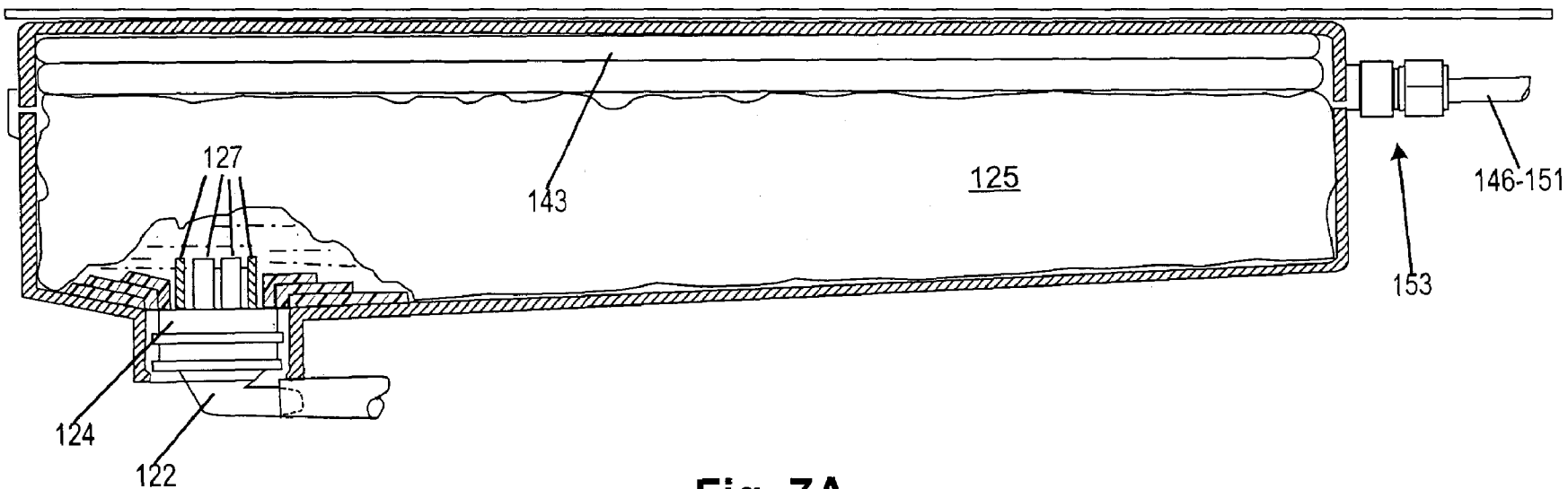
FIG. 7A is a cross-sectional view of one drawer in the refrigeration unit and illustrates an inflatable bladder, flexible liquid bag and the fitment of FIGS. 6A and B.

As shown at 131–136 in the cross-sectional view of FIG. 7, for liquid flow, bottoms of the drawers 91–95 slope towards the opening through the connection 124 and fitment 122. In addition to each liquid containing flexible bag 125, each drawer contains an expansible bladder 143 like that shown in FIG. 7A. This bladder is supplied air under pressure from the pump 64 via compressed air lines 146–151 through couplings 153. The expansible bladders 143 are confined in force exerting relation to the flexible, collapsible liquid containing bags 125. As shown in the broken away portion of bag 125 in FIG. 7A, the upstanding prongs 127 of the fitment 122 project into the bag somewhat higher than the bag bottom at the opening from the bag. These prongs prevent collapse of the bag under the influence of the expansible bladder 143 into liquid flow-blocking relation to the opening as the liquid is exhausted. The upstanding prongs define between them spaces through which the liquid can flow until the collapsed bag 125 is substantially completely empty.

Figure 8A:
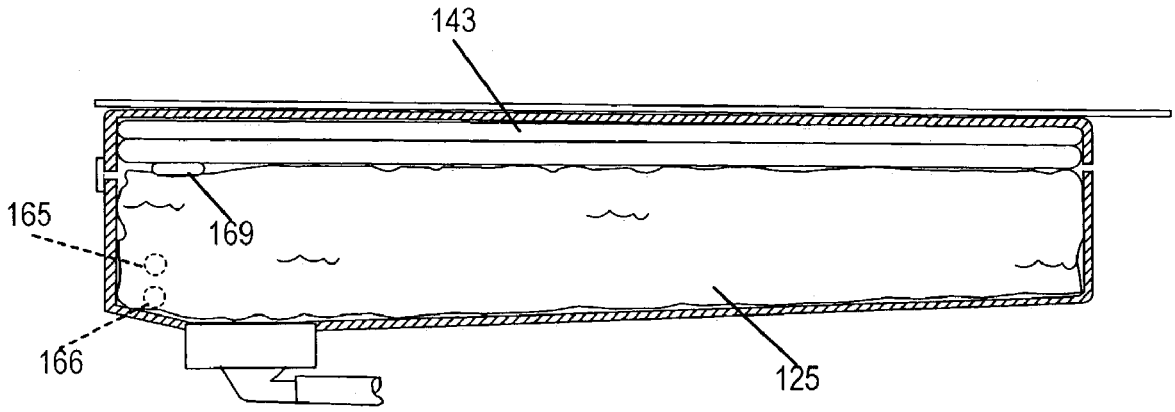
FIGS. 8A–D are cross-sectional views showing a drawer having an inflatable bladder in pressure exerting relation to a flexible consumable liquid bag that is full, partially emptied, and entirely emptied.
Figure 8B:
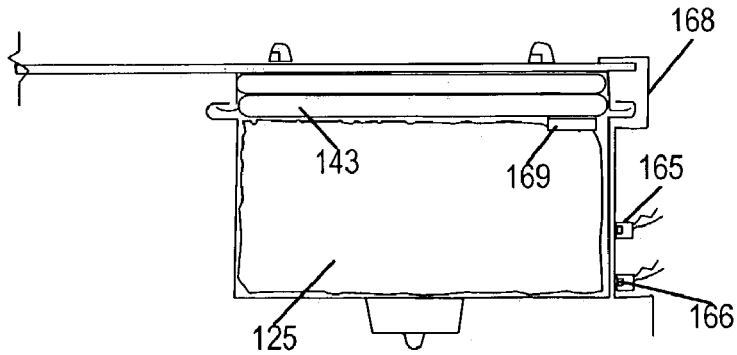
Figure 8C:
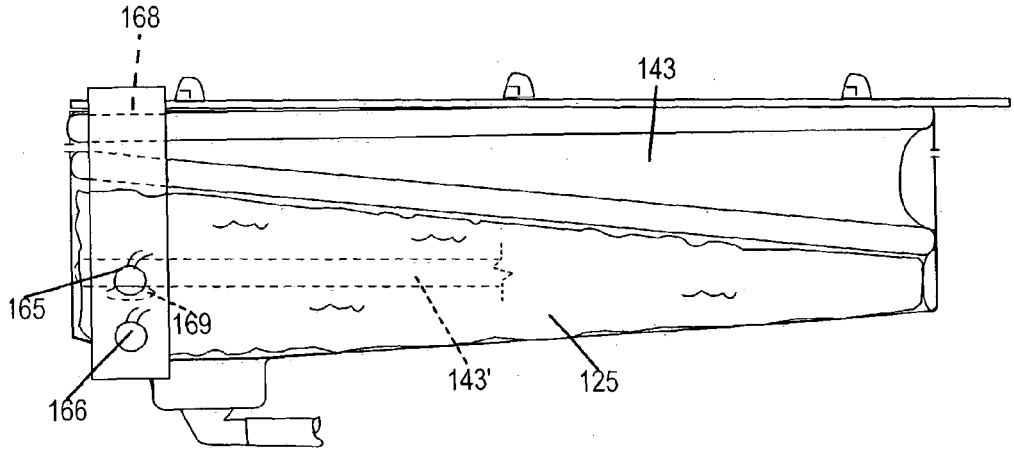

Shown in FIG. 8C a pair of Hall switches 165 and 166 are mounted by a bracket 168 to detect the proximity of a magnet 169. The magnet 169 is secured, by for example gluing, to the bottom of the bladder 143. This arrangement serves as a sensor to detect and indicate a low liquid level and an out-of-liquid condition.

Figure 8D:
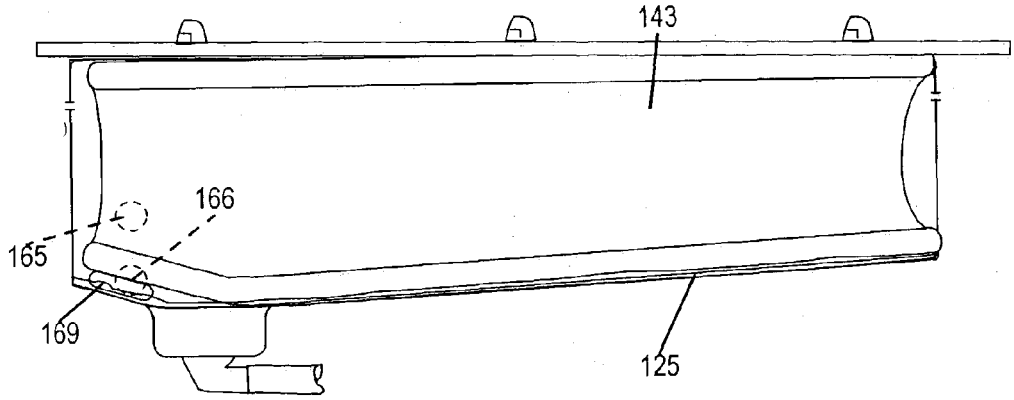

FIGS. 8A and 8B illustrate the inflatable bladder 143 collapsed when the bag 125 is completely full. FIG. 8C shows the bag 125 partially empty and the bladder 143 partially inflated. Shown in full lines in FIG. 8C, the bag 156 is not yet at the low liquid level, but shown in broken lines at 143' is the location of the bottom surface of the bladder 143 when it has brought the magnet 169 into proximity with the low liquid level Hall switch 165. This causes a change of state in the Hall switch used to indicate low liquid level. Finally, in FIG. 8D, the "out-of-liquid" condition is sensed by the hall switch 166 when the bag 125 is substantially empty and the bladder 143 is completely inflated. By a simple electrical circuit known in the art, the switches 165 and 166 are electrically connected to and turn on "low-level" and "out-of-liquid" LED indicators (not shown). These are located on the fountainhead where they will be visible to an attendant.

In FIGS. 9–13, the fountainhead 28 is shown in further detail. In the right side view of FIG. 9 it can be seen that the fountainhead 28 is constructed of three molded pieces. These are the front 171, the top 172 and the back 173. In the top view of FIG. 10 a slot 175 in the top 172 receives a downward extending tab 176 of the placard 45, to support the placard.

Figure 11:
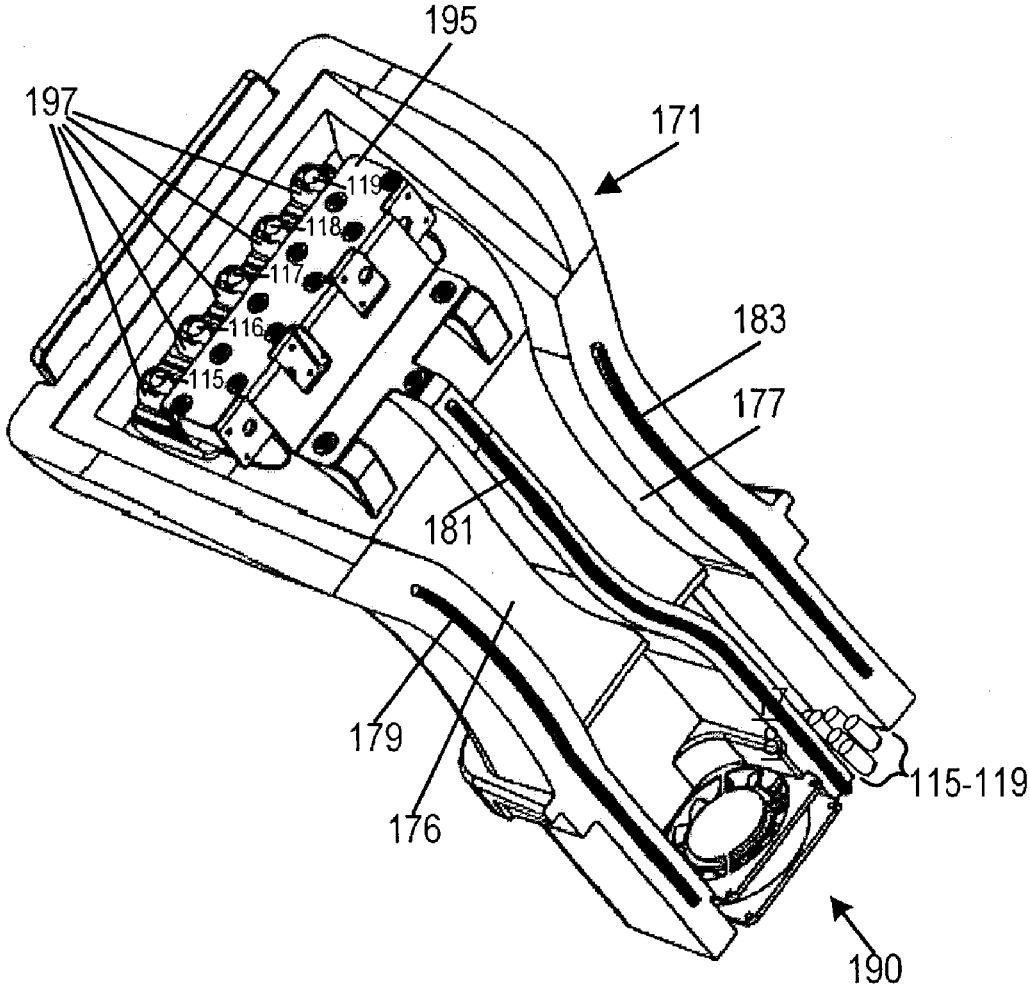
FIG. 11 is a perspective view of a front section of a fountainhead in accordance with the invention and shows air movement conduits therein.
Figure 12:
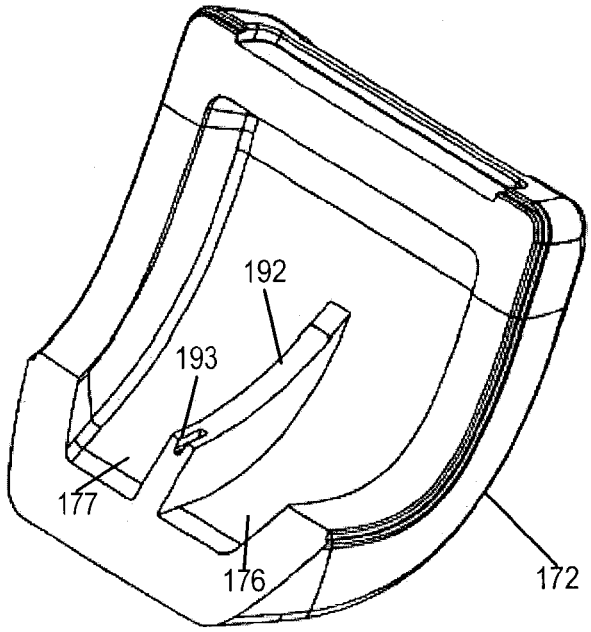
FIG. 12 is a perspective view of a top part of the fountainhead of FIG. 1.
Figure 13:
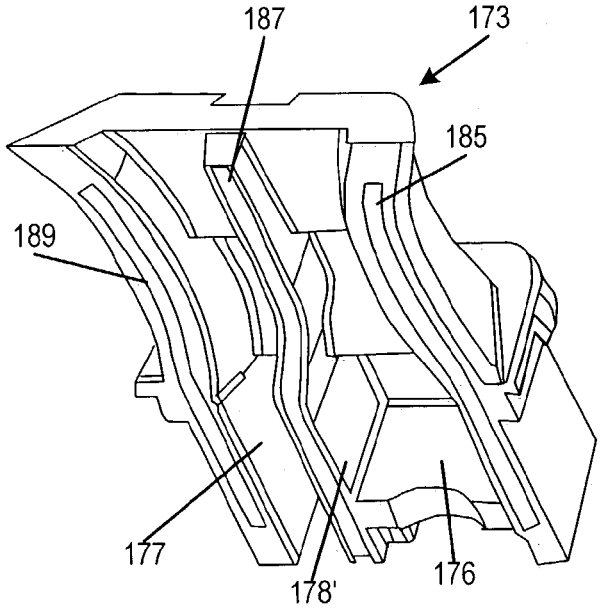
FIG. 13 is a perspective view of a rear part of a stem portion of the fountainhead of FIG. 1.

The three molded elements 171, 172 and 173 that make up the fountainhead are shown in FIG. 11, 12 and 13, respectively. These are molded of an insulating material, such as a plastic foam sandwiched between inner and outer plastic "skin" layers. There the internal construction of the fountainhead can be seen. The front 171 and back 173 come together to form two channels 176 and 177 separated by a molded baffle 178, 178'. The channels 176, 177 lead upward from the stem 147 and are in communication with the refrigeration unit below. At their interface, the front 171 carries seals 179, 181 and 183 in long slots extending along the sides of the channels 176 and 177. These seals are received in conforming slots 185, 187 and 189 formed in the back 173 along the channels 176 and 177 where the back and front interface. Carried in the bottom of the channel 176 a fan 190 delivers refrigerated air into the channel 176. The refrigerated air travels up the channel 176, circulates about the interior of the fountainhead at its top and is withdrawn back into the refrigeration unit along the channel 177. It is through the channel 177 that the flexible tubes 115–119 pass on their way to the dispensing location at the underside of the front 171 of the fountainhead 28. The top 172 of the head 28 as seen in FIG. 12 has a short section 192 of the baffle that separates the channels 176 and 177. A short slot 193 receives an upper end of the seal 181 of FIG. 11.

Held in place by a bracket 195, as seen in FIG. 11, five pinch valves 197 receive the ends of the tubes 115–119. From FIGS. 11, 12 and 13, it will be seen that the liquid supply tubes 115–119 are cooled along their length as they proceed through the refrigeration unit and into the fountainhead. This cooling is particularly important for dairy product that must be maintained below a government prescribed temperature.

Figure 14:
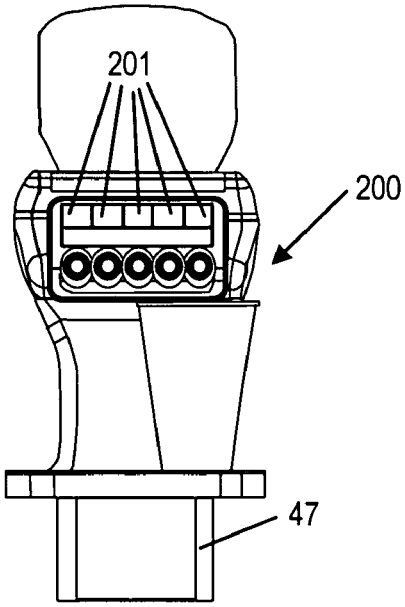
FIG. 14 is a front elevation view of a fountainhead with electrically operated dispensing valves.

In an alternate embodiment of the invention illustrated in FIG. 14, solenoid driven pinch valves, known in the art and commercially available, are used. The fountainhead 200 of this embodiment has electrically operative touch pads 201 or other electrical switch activation means to activate a solenoid and cause the release of a pinch valve normally biased closed as is known in the art. In other respects, the head 200 is similar to the head 28 previously described. Cooling air flow is the same as described with respect to the head of FIGS. 11, 12 and 13. A temperature readout like that of FIG. 1 indicates temperature within the dispensing head and low liquid and out of liquid LEDs can be provided.

Figure 15:
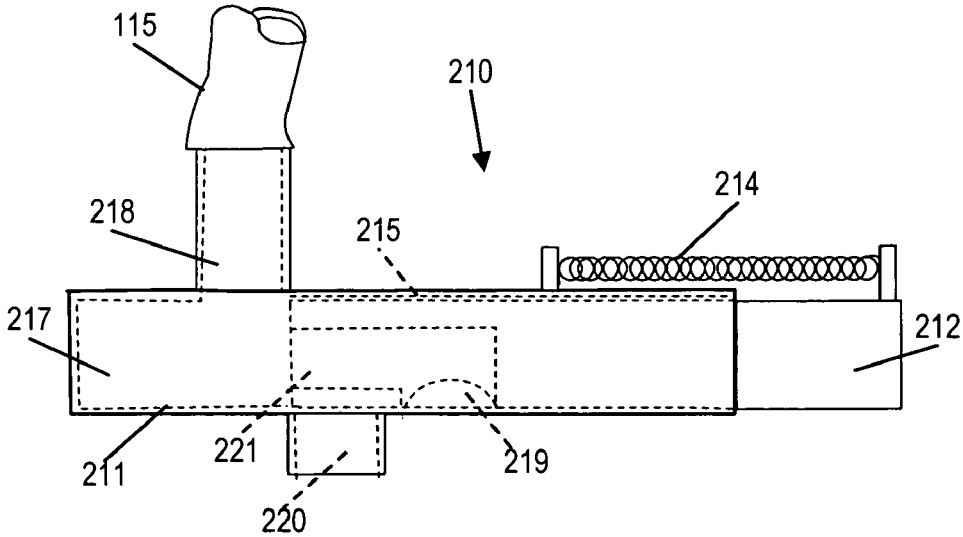
FIG. 15 is a diagrammatic illustration of a dosing dispensing valve.

FIG. 15 illustrates an alternative to the previously described pinch valves controlling the flow of liquid from the fountainhead 28. The valve 210 of FIG. 15 connects to the output end of a flexible liquid supply tube 115 for example. A housing 211 receives a slide 212. The slide is urged by spring 214 to the rest or home position at which it is shown in FIG. 15. The slide fits in liquid-tight relation to the housing. However at a location along its perimeter an air escape passage 215 is provided such as a channel or flat or other configuration forming a space between the valve slide and its housing communicating between the interior of the housing 211 and atmosphere. In the home position of the slide as shown the slide 212 and the housing 211 form a chamber 217. The chamber communicates with the tube 115 through an opening in the chamber at 218. Liquid product from the refrigeration unit enters the chamber 217, filling it. Air displaced by the liquid as it fills the chamber 217 escapes along the passage 215 allowing the chamber 217 to be filled with liquid. To measure out a consistent portion of the liquid, the slide 212 is pushed to the left in FIG. 15, either manually or by activation of a solenoid or the like. An opening 219 in the slide moves into alignment with an output opening or spout 220 opening into the housing 211. At that point liquid in the chamber 217 is forced out of the chamber 217 into a hollow interior 221 or other path or passage through the slide 212 and out of the valve through the opening 219 and the spout 220. The exterior of the slide 212 closes off the opening 218 as it is pushed to the left and a measured dose of the liquid is dispensed. Upon release of the slide 212 it returns to its home position under the urging of the spring 214. Initially, air moves into the chamber 217 allowing the slide to move towards its home position and until the opening 218 is again opened into the chamber 217. At that time, chamber 217 again fills as air is expelled.

Figure 16:
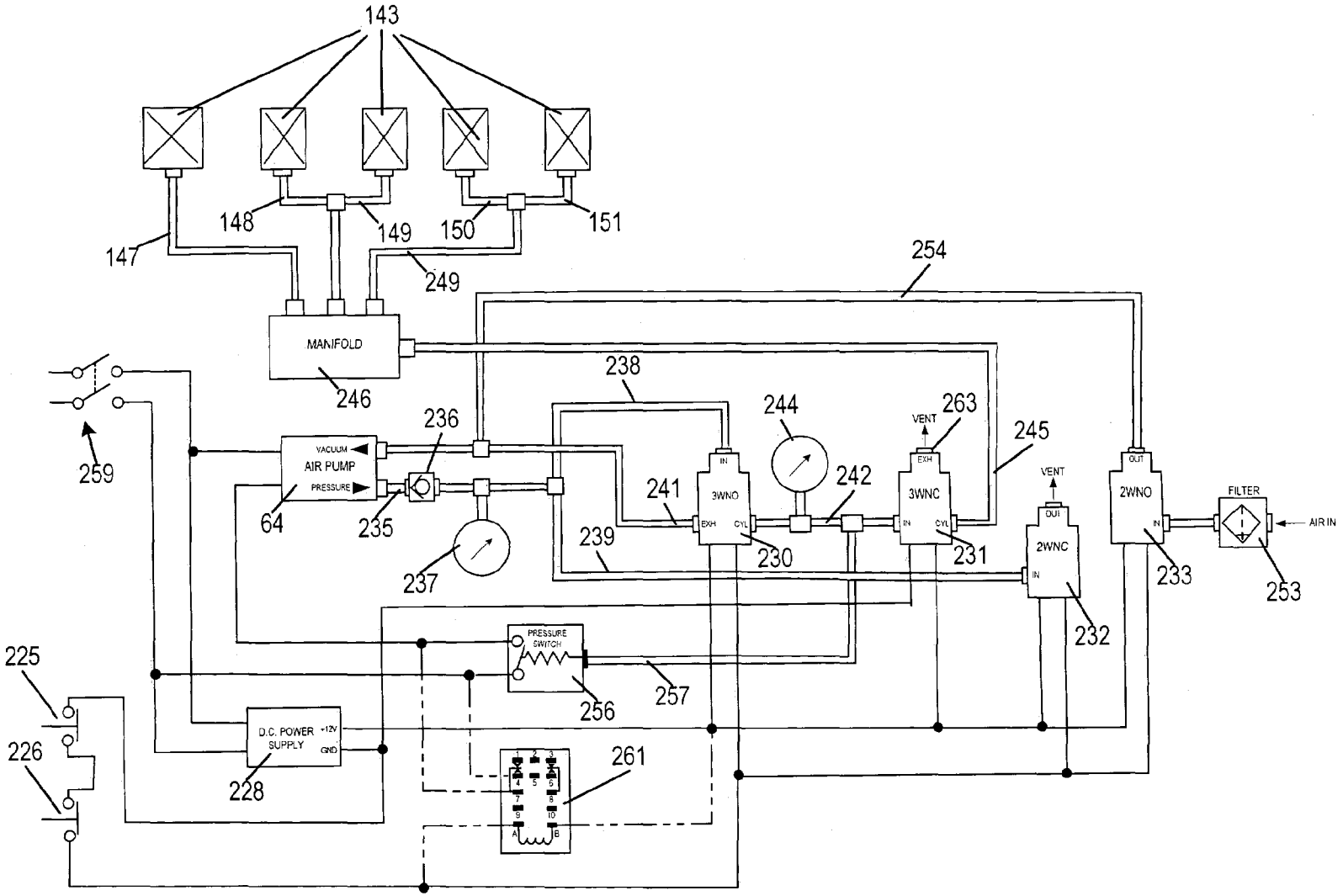
FIG. 16 is a schematic illustration of the electrical and compressed air circuits of the dispensing system of the invention.

Returning to FIG. 6 a pair of safety shut off safety interlock switches 225 and 226 are supported on the shell of the refrigeration unit 50 to be activated by the door of the unit when the door is closed. Any suitable commercially available switch can serve. Limit switches and proximity sensors are just two alternatives that may be used. How those switches operate is better described in connection with the circuit of FIG. 16. There the switches 225 and 226 are seen to be connected in series and are hence redundant for a greater measure of safety. Opening one or both switches, by opening the door of the unit 50, interrupts a circuit from a DC power supply 228 to four electrically operated valves 230, 231, 232 and 233. Ordinarily, with the door of the refrigeration unit 50 closed, air pump 64 is operative to apply air pressure elevated to something less than 8 PSI to an output line 235 and through a check valve 236. Air is supplied to the vacuum side of the pump 64 via a filter 253, valve 233 and a line 254. An air pressure meter 237 monitors the pressure in the line 235. From the line 235 the increased air pressure branches to lines 238 and 239. Air pressure line 238 serves as an input to the first valve 230, a valve that maintains the connection between a pair of air lines 241 and 242 normally open. In its normally open state the valve 230 applies the air pressure of the line 238 to the line 242. A further pressure meter 244 monitors that pressure. The second valve 231 maintains the connection between the line 242 and a further line 245 normally closed. The line 245 applies the increased air pressure output of the pump 64 to a manifold 246 which distributes the air at the raised pressure to the bladders 143 via lines 248 and 249 and the lines 147–151 previously discussed. A pressure switch 256 monitors the pressure in the line 242 via a line 257 to interrupt the circuit from mains power at 259 to the pump 64 when that pressure falls. Initially, at startup, pressure is built in the line 242 by the pump by means of a timed breaker 261 that, upon application of the output of the DC power supply shorts out the pressure switch 256 for a period sufficient to pressurize the system.

When one or both safety switches 225 and 226 open, the valve 230 connects the air lines 241 and 242 thus connecting line 242 to the intake of the pump 64 and dropping the pressure in the line 242. The valve 231 at the same time vents the line 245 to atmosphere through the valve outlet 263 marked "EXH." Through the manifold 246 the bladders 143 are thus vented to atmosphere, deflating the bladders and making it safe to open the drawers containing the bladders and the flexible bags containing the liquid product. The output of the pump 64, also, is vented to atmosphere by the closing of the normally closed valve 232. The air intake and filter 253 are disconnected from the vacuum side of the pump 64 by the opening of the normally open valve 233. The loss of air pressure in the line 242 is communicated to the pressure switch 256 which interrupts the mains power to the pump 64.

Although preferred embodiments of the invention have been described in detail, it will be readily appreciated by those skilled in the art that further modifications, alterations and additions to the invention embodiments disclosed may be made without departure from the spirit and scope of the invention as set forth in the appended claims.

I claim:

1. A dispenser for consumable liquids comprising:

(a) a compartment for receiving a flexible, at least partially collapsible container of consumable liquid, in a container receiving location therein, (b) a compressed gas activated pressure applicator secured at a location contiguous to the container receiving location and adapted to apply container-collapsing pressure to the container in the container receiving location, (c) a liquid dispensing location, (d) a consumable liquid flow channel defining a liquid flow path communicating between the container receiving location and the liquid dispensing location, (e) a consumable liquid control valve operatively connected to open and close the flow path and control the dispensing of consumable liquid at the liquid dispensing location, (f) an upstanding stem on the counter, (g) a dispensing head supported above the counter by the stem at the dispensing location, the flow channel passing from the compartment through the counter, and through the upstanding stem to the dispensing head, and (h) a valve activating means at the dispensing head, wherein, in operation, the flow channel receives along its length a flexible liquid delivery tube communicating between the interior of the flexible liquid container, through the channel to the dispensing head and is electrically activated.

2. A dispenser for consumable liquid comprising:

(a) a compartment located below a counter for receiving a flexible, at least partially collapsible container of consumable liquid, in a container receiving location therein, (b) a compressed gas activated pressure applicator secured at a location contiguous to the container receiving location and adapted to apply container-collapsing pressure to the container in the container location, (c) a liquid dispensing location located above the counter, (d) a consumable liquid flow channel defining a liquid flow path communicating between the container receiving location and the liquid dispensing location, (e) a consumable liquid control valve operatively connected to open and close the flow path and control the dispensing of consumable liquid at the liquid dispensing location, (f) a refrigeration unit below the counter in cooling relation to the compartment location container the liquid container, and (g) at least one safety interlock switch connected in controlling relation to a gas release path connected with the pressure activator to release compressed gas therefrom and relieve pressure therein to prevent potentially injurious expansion of the activator under pressure, the safety interlock switch being a position detecting switch mounted proximate a doorway giving access to the compartment and activated by opening the door in the doorway.

3. A dispenser for consumable liquid comprising:

(a) a compartment located in a cabinet below a counter for receiving a flexible, at least partially collapsible container of consumable liquid, in a container receiving location therein, (b) a compressed gas activated pressure applicator secured at a location contiguous to the container receiving location and adapted to apply container-collapsing pressure to the container in the container receiving location, (c) a liquid dispensing location located above the counter, (d) a consumable liquid flow channel defining a liquid flow path communicating between the container receiving location and the liquid dispensing location, (e) a consumable liquid control valve operatively connected to open and close the flow path and control the dispensing of consumable liquid at the liquid dispensing location, and (f) at least one safety interlock switch responsive to opening of the cabinet and in controlling relation to a gas release path connected with the pressure activator to release compressed gas therefrom and relieve pressure therein to prevent potentially injurious expansion of the activator under pressure upon opening of the compartment.

4. A dispenser of dairy product for consumable liquids comprising:

(a) a refrigerated enclosure, (b) a store for consumable liquid in the enclosure, (c) a delivery system for moving the consumable liquid along a path to a dispensing location remote from the enclosure, and (d) an air mover located to move temperature-controlled air from the enclosure along the path to control the temperature along the path, the path of the delivery system comprising a conduit for passage of a flexible dairy product delivery tube to a dispensing head formed of insulating material and further comprising temperature indicating means carried on the dispensing head for indicating temperature within the dispensing head.

5. A dispenser for consumable liquids comprising:

(a) a refrigerated enclosure, (b) a store for consumable liquid in the enclosure, (c) a delivery system for moving the consumable liquid along a path to a dispensing location remote from the enclosure, and (d) an air mover located to move refrigerated air from the enclosure along the path to control the temperature along the path, the path of the delivery system comprising a conduit for passage of a flexible dairy product delivery tube to a dispensing head, the dispensing head including a pinch valve normally pinching the dairy product delivery tube closed proximate an end of the tube at the dispensing head, the air mover directing refrigerated air along the dairy product delivery tube in the conduit to the delivery head and proximate the end of the dairy product delivery tube, and the conduit includes a return path of air flow opening into the enclosure for returning air to the chamber from the dispensing head.

6. The dispenser according to claim 5, wherein the air mover comprises a fan located to move refrigerated air out of the enclosure into and along the conduit to the delivery head and back along the return path to the enclosure.

7. A liquid dispenser comprising:

(a) a source of compressed air, (b) means for receiving a collapsible container of liquid, (c) means communicating between the means for receiving the collapsible container and a liquid dispensing location, (d) an inflatable air bag, (e) means for confining the inflatable air bag proximate the collapsible container location in force exerting relation to a collapsible container when located there, and (f) means connecting the source of compressed air to the air bag to inflate the bag thereby causing the liquid to be expelled from the container, and (g) a liquid level sensor including (i) at least one magnetic element secured to the inflatable bag and (ii) a magnetic sensing device supported to sense movement of the magnetic element into proximity with the sensing device as the inflatable bag expands against a collapsing container as liquid is dispensed.

8. The liquid dispenser according to claim 7, wherein the magnetic sensing device is supported at a location proximate the location to which the magnetic element moves when the collapsible container is substantially empty and fully collapsed.

9. The liquid dispenser according to claim 8, further comprising a further magnetic sensing device supported at a location to which the magnetic element moves when the container is partially empty and is partially collapsed.

10. The liquid dispenser according to any one of claims 7–9, wherein each magnetic sensing device is a Hall switch.

11. The liquid dispenser according to any one of claims 7–9, wherein each magnetic sensing device is connected in controlling relation to a liquid level indicator.

* * * * *